United States Patent [19]

Artbauer

[11] 4,175,212

[45] Nov. 20, 1979

[54] ELECTRICAL CONDUCTOR ASSEMBLY

[75] Inventor: Jan Artbauer, Hanover, Fed. Rep. of Germany

[73] Assignee: Kabel- und Metallwerke Guthehoffnungshutte Aktiengesellschaft, Hanover, Fed. Rep. of Germany

[21] Appl. No.: 847,091

[22] Filed: Oct. 31, 1977

[30] Foreign Application Priority Data

Oct. 29, 1976 [DE] Fed. Rep. of Germany ..... 2649398
Mar. 3, 1977 [DE] Fed. Rep. of Germany ..... 2712222

[51] Int. Cl.[2] ..... H01B 9/00

[52] U.S. Cl. ..... 174/128 R; 174/13; 174/130; 174/131 R

[58] Field of Search ..... 174/13, 15 C, 28, 128 R, 174/130, 131 R, 131 A, 131 B, 129 S

[56] References Cited

U.S. PATENT DOCUMENTS

| | | | |
|---|---|---|---|
| 2,306,527 | 12/1942 | Daniels | 174/13 |
| 2,458,243 | 1/1949 | Biddle | 174/131 A |
| 3,324,233 | 6/1967 | Bryant | 174/131 R |
| 3,541,221 | 11/1970 | Aupoix et al. | 174/13 |
| 3,831,636 | 8/1974 | Bittnev | 174/28 |
| 3,864,508 | 2/1975 | Beck | 174/131 R |
| 4,031,310 | 6/1977 | Jachimowicz | 174/15 C |

*Primary Examiner*—Richard R. Kucia
*Assistant Examiner*—John H. Bouchard
*Attorney, Agent, or Firm*—Smyth, Pavitt, Siegemund. Jones & Martella

[57] ABSTRACT

An inner conductor for a gas filled high voltage cable is constructed from plural elements arranged on a carrier tube in one or several layers. The conductive elements are either stranded around the carrier while remaining spaced from each other so that they can deform azimuthally in a wave-like pattern whenever their temperature increases, or alternatively, the conductor elements remain unstranded and are already contoured in a wave-like pattern whose amplitude excursion increases with temperature. In either case, length extensions of the elements are taken up by the wave pattern and do not cause overall length extensions of the conductor assembly as a whole.

7 Claims, 7 Drawing Figures

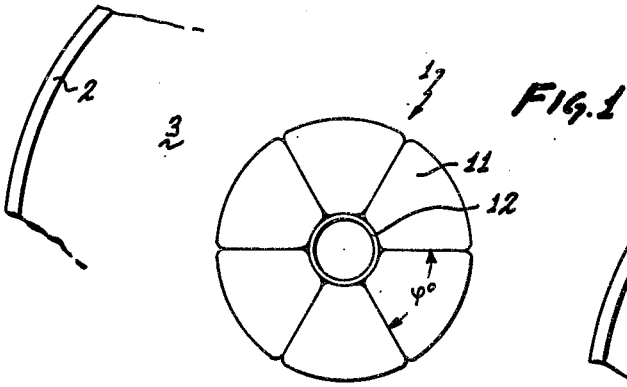
FIG. 1
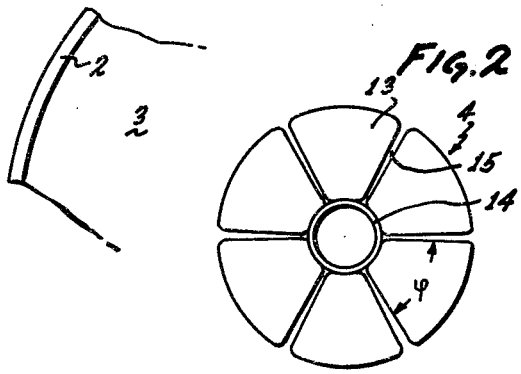
FIG. 2
FIG. 3
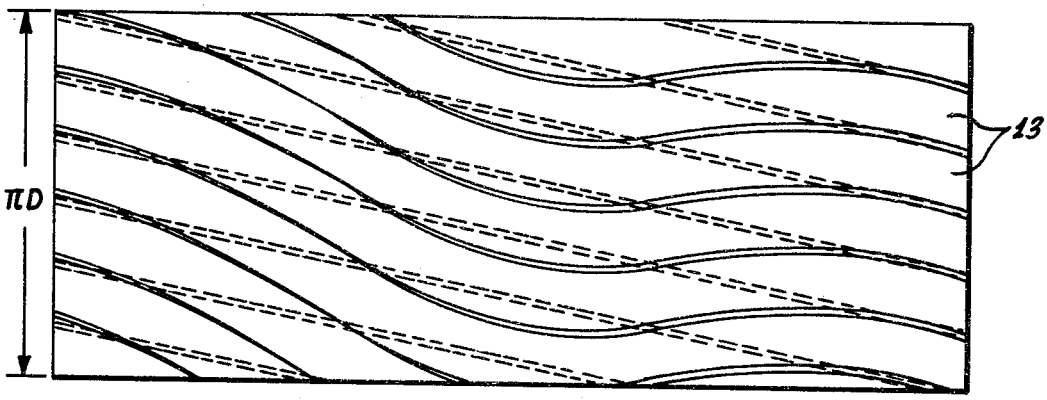
FIG. 4
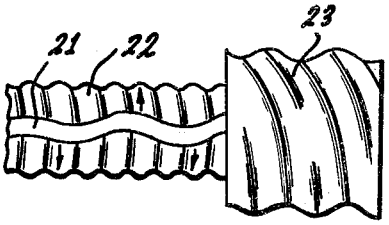
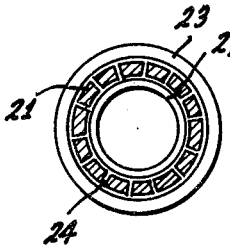
FIG. 5
FIG. 6
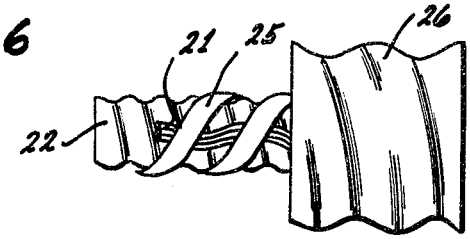
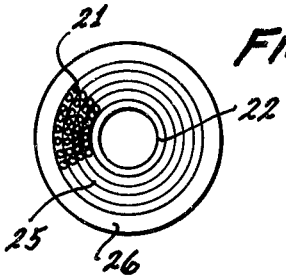
FIG. 7

ELECTRICAL CONDUCTOR ASSEMBLY

BACKGROUND OF THE INVENTION

The present invention relates to the construction of conductors for electrical cable to be used for the transmission of power, particularly at high voltages. More particularly, the invention relates to a gas insulated, high voltage cable having an inner conductor which is comprised of multiple conductor elements.

Generally speaking, the transmission of large quantities of electrical energy requires a large voltage and/or a large cross-section of the conductor or conductors used for that purpose. If the conductor(s) is included in a cable one needs correspondingly strong insulation, whereby basically a choice has to be made between a solid type insulation or a gas insulation. A solid insulation can be constructed from laminated dielectric material being, e.g., impregnated with oil. Alternatively, one may extrude such insulation upon the conductor. As far as the latter case is concerned, regular or cross-linked polyethylene is a commonly used insulating material. A gas insulated cable includes, for example, a conductor which is concentrically or coaxially arranged in a tube, and the space between the tube and the conductor is filled with a suitable gas, e.g. $SF_6$. In addition, of course, the conductor must be held in the tube by spacers.

The high voltage cables outlined above differ substantially in their constructions, but they all have a common feature, namely, they are heated under load and tend to expand particularly in longitudinal direction. This tendency is, of course, the stronger, the higher the operating temperature. The expansion has to be taken up at some point by the cable, and in this connection, it was found that the mounting, holding or other connecting fittings or devices at the ends of the cable will, in fact, experience that load, possibly even to such an extent that the cable end elements are severely damaged. However, other parts of the cable, particularly those portions which do not run along a straight line, experience the thermal load because the resulting force in the cable has a radial component in the curved cable portion. As stated, gas-insulated cable has a conductor which is centrally positioned in the cable tube, and in isolated places only, e.g., by means of plastic spacers. If length extension of the cable is impeded, these spacer elements may have to take up excessive mechanical loads and are deformed or possibly even damaged.

As a representative example for the state of the art, we refer to U.S. Pat. No. 3,852,511. It should be noted that the corrugation of the outer tube of the cable takes care of the thermal expansion problem of that tube, but does not solve the problem of the thermal expansion of the inner conductor. Earlier patents of general interest are, for example, U.S. Re-Issued Patent No. 20,244 or U.S. Pat. No. 2,067,169. In a paper of general interest by C. T. W. Sutton, *Energy International*, March 1971, power cables are discussed in general and the thermal expansion problem is mentioned, but the paper does not provide a solution.

DESCRIPTION OF THE INVENTION

It is an object of the present invention to provide a new and improved conductor construction for use in a cable and under conditions which may require accommodation to high temperatures and to the corresponding dimensional changes of such a conductor.

It is a particular object of the present invention to improve the inner conductors in a high-voltage cable particularly of the gas-insulated variety, whereby the inner conductor is comprised of plural elements.

In accordance with the preferred embodiment of the present invention, it is suggested to arrange multiple conductor elements (strands) on a carrier element in such a manner that the conductor elements, upon suffering thermal expansion, undergo lateral deflection in alternating directions along the circumference of the conductor elements taken as a group, so that these elements have a wave-like appearance, the waves having a phase coherency so that the several elements do not interfere with each other. In a first example, it is suggested to strand the conductor elements around a common axis as is known per se, but leaving gaps between them so that each can undergo a wave-like distortion along its helical contour due to the stranding. In a second example, it is suggested to place the elements around a common axis without stranding them, but to impart upon each of them a wave-like contour whose amplitude can increase upon thermal expansion.

Turning to particulars of the first example (stranding), it is suggested to space the individual conductor elements apart from each other and on a circle which extends around the common stranding axis so that these elements occupy less space in azimuthal direction. If d is the diameter of a lay of conductor elements, known conductors in a stranded lay occupy the full circumference $\pi$ d of that lay. We have discovered that just by leaving gaps here, so that the conductor elements of that lay do not occupy the full circumfernce $\pi d = U$ but only $K \cdot U$ with $K < 1$ being between 0.9 and 0.99, preferably between 0.95 and 0.98, the thermal expansion problem is being solved. Normally (and without thermal load), such a stranded conductor element has a helical configuration, i.e. it extends along a helical line about the common axis of stranding for all elements. The gaps between the conductor elements permit each of them to undergo an additional, lateral, wave-like, i.e. sinusoidal, deflection. This deflection occurs normal to the helical lines of the regular extension of the element and in the circumferential direction of the stranded arrangement and lay to which the conductor element pertains. Upon being heated, the conductor will follow that helical line only on the average because the length extension at elevated temperatures deflects each conductor laterally. Thus, the conductor elements will not exhibit any overall length extension as far as the cable as a whole is concerned, although each element does become longer; that length extension, however, is taken up by the deflection as each conductor element assumes a sinusoidal contour.

It should be realized that the conductor elements may be stranded with reversing pitch, but this aspect does not interfere with the inventive feature. Also, the conductor may be constructed from more than one lay of stranded conductor elements in which case one should apply the inventive rule to each lay. It will be realized further that the providing of gaps between adjacent elements of a lay reduces to some extent the cross-sectional area of conductor material available for current condition. For this reason, one should not go below the $K = 0.9$ value, preferably not even below 0.95 in order not to incur a loss in transmission power.

As far as the second example is concerned (no stranding), the several conductor elements are placed on a core element without being twisted together, but each element has a wave-like contour whose amplitude extends peripherally in relation to the core element. As the conductors heat, the amplitude of each "wave" increases, which suffices to compensate the length extension of each element without causing the overall length of the element in the cable to extend beyond the length extension of the cable as such. Thus, one readily avoids damage to the connecting elements etc. of the cable. The conductor elements may be provided with the wave-like contour upon being placed on the carrier or core, or the conductors may have a pre-shaped meandering contour. The conductor elements should be spaced from each other on the inner core, with possibly a tubular element placed on top of the conductor element assembly. Both core and cover tube may be constructed as corrugated tubes. Also, in this case, multiple lays or layers of conductor elements may be provided. These layers may be separated by ribbons wound around the conductor elements of each lay.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a cross-section through a known inner conductor composed of multiple elements;

FIG. 2 is a similar cross-section through a conductor element assembly improved in accordance with the invention;

FIG. 3 is a (geometric) development of the conductor element of FIG. 2 as stranded;

FIG. 4 is a side view of an incomplete inner conductor assembly showing but one element for the sake of clarity;

FIG. 5 is a section through lines 5—5 in FIG. 4, except that all elements are shown here;

FIG. 6 is a side view into a complete inner conductor for a cable with unstranded conductor elements; and FIG. 7 illustrates a multi-lay assembly for an inner conductor.

Proceeding now to the detailed description of the drawings, FIG. 1 illustrates a conductor 1, being, in fact, an inner conductor and contained in a tubular outer conductor or shield 2. The space 3 between the conductors 1 and 2 is filled with insulative gas, e.g. $SF_6$. The conductor 1 itself is composed of six segments 11 made, e.g. of aluminum or copper, and having an angle at the centre of 60°. The segments 11 are mounted on top of a tubular support element 12 made, e.g. of metal. The support or carrier element 12 may either be a solid tube in which case it may also serve as a conduit for a coolant. Alternatively, element 12 may be a steel coil. In either case, the six elements establish a gapless lay.

During operation, that is upon transmission of an electric current through the elements 11, the temperature of these elements rise. Since the elements cannot extend in longitudinal direction, i.e. transversely to the plane of the drawing, thrust forces are produced which can destroy the insulation, sleeves or other terminal fittings of the cable. By way of example, a conductor having the length Lo and undergoing a temperature rise of $\Delta T$, will extend by $\Delta L = \alpha \cdot \Delta T \cdot Lo$, wherein $\alpha$ is the coefficient of thermal expansion of the particular conductor material. Since, however, the conductors in a cable cannot expand in such a manner, forces are produced which can be calculated generally as follows. An object of length Lo and cross-section Q, when compressed by a force F, will undergo a length change $\Delta^*L$ given by $F = EQ \cdot \Delta^* L / Lo$, wherein E is the modulus of elasticity. If one assumes $\Delta^*L = \Delta L$, then the thermal expansion is completely compensated by a compression of the conductor in the opposite direction. The same force F, however, is reacted by the conductor into the support and/or terminating and connecting structure.

In order to realize the magnitudes of the parameters and of the resulting forces herein involved, consider a conductor of 1000 $mm^2$ cross-section and a temperature increase of 100° Centigrades, such rise in temperature easily occurring in certain overload situations including a short circuit. In the case of a copper conductor ($E = 12{,}000$ kilogramm/$cm^2$), having a thermal expansion coefficient $\alpha$ of $16.10^{31\ 6}$ (length increase per unit length and per degree Centigrade), one obtains a force in kilogramms of 19,200. In the case of aluminum ($E = 7000$, $\alpha = 24$), the force is 16,800 kilogramms. Due to stranding, the actually occurring forces are somewhat lower than in the case of unstranded solid conductors, but the forces are still so large that indeed connection sleeves, terminal fittings, etc., and also insulation spacers, for example, can be severely damaged due to the radial component of a curving cable.

Turning now to FIG. 2, there is again shown a tube 14 upon which have been stranded six conductor elements 13 to establish the inner conductor 4. The cable has also an outer tube 2, and a gas filled space 3 as before. However, the elements or segments do not abut. Rather, there are provided gaps 15 in between two adjacent segments 13. The gaps are shown to be evenly distributed, but this is not necessarily the case. Rather, it is essential that there be sufficient gap space around the circumferences of that particular conductor lay. These gaps 15 permit the element 13 to yield individually and in lateral direction upon increasing of the conductor temperature during operation. Thus, each element is enabled to undergo a thermal expansion without setting upon internal tension of any significant magnitude. This is so, as the lateral deflection each element is permitted to undergo, does not produce any significant overall length extension of the conductors in the cable, because each element has sufficient space for undergoing lateral deflection so as to expand into the excursions of a sinusoidal deflection pattern. The expanding elements, therefore will not damage the cable.

Specifically, the individual segments may, of course, longitudinally expand when heated, but without undergoing an overall length extension. Rather, the individual elements deflect laterally as shown in FIG. 3. Each conductor element, originally having a helical contour due to stranding, will be deformed into a wave-like, sinusoidal pattern, as can be seen from FIG. 3. The angle of pitch of each stranded element is, of course, no longer constant, but alternates locally around an average value (being the original one), between a larger and a smaller value. Locations in which the pitch is smaller are characterized by the fact that the actual cross-section, taken in a plane which extends precisely at right angles to the cable and stranding axis and runs through such a conductor, is somewhat larger than normal because the conductor occupies more space in these locations. This is made possible by the gaps 5.

Due to the trunkated pie-shape of the cross-section of each conductor element, any circle around the axis, including a circle with a diameter that is regarded as the diameter of this particular lay of stranded conductors, passes through material by less than 100% of its periphery. As to other types of cross-sectional contours for such conductor elements, the relevant gap width will be the sum total of the smallest distances between respective two adjacent elements. These incremental gaps must not be otherwise occupied but must be fully available as yielding space into which a conductor element may laterally deflect.

In the following, an example will be given as to the size of the gap that is needed or desired. Each of the six elements 13 has been allotted for occupancy a sector of 60°, but does not occupy that sector fully (as the elements 11 do in FIG. 1). In order to take up longitudinal expansion by undergoing a wave-like distortion, an element must have a sector angle smaller than 60°. Just how small is determined from the consideration that a total length extension of $\Delta L$ over any length of the cable is to be taken up by one or several excursions whose "amplitude" is a measure for the needed gap width. It was found that the sector angle of occupancy for aluminum conductors must be reduced by a factor K which (for 100° C. temperature increase) is 0.97 so that the sector angle is only 58.2°, i.e. each gap must have an angular width of about 1.8°. Reducing the factor K to 0.95 increases the margin of safety. A further reduction in peripheral occupancy by conductor material in the lay has to be considered with caution, since the available cross-section of conductive material will be reduced. Of course, one could increase the other dimension of the inner conductor in order to compensate for the loss in conductive material due to the gaps 5. Such an increase, however, poses additional problems, as it reduces the radial width of the insulation space 3 which, in turn, could be compensated by making the tube 2 larger. However, all these modifications would necessitate further modifications elsewhere. Thus, the inventive examples must be explained as being related to a rule for avoiding the thermal expansion problem of a cable of otherwise predetermined dimensions and electrical parameters, and that poses a constraint on reducing the azimuthal dimensions of the stranding elements. It should be noted further that stranding the conductor elements with reversing twist is a particularly advantageous way of practicing the invention. Also, multi-lay stranding of conductors requires that the stated rule be applied to the conductor elements of each lay.

The example shown in FIG. 4 includes a corrugated tube 22 made of metal and also to be used as a conduit for a coolant. The figure shows a single conductor 21 which extends in axial direction on the tube 22, but the conductor element 21 has a meandering or sinusoidal contour in peripheral direction of the carrier tube 22. The element 21 may be a flat strip and constitutes only one of several which are arranged on tube 22. FIG. 5 shows clearly that there is a plurality of such conductor elements 21.

If the conductor temperature increases, the elements 22 undergo some deformation in that the excursion width or amplitude of the wave-like contour pattern increases, as representatively indicated by the arrows. Since the conductor elements are arranged in azimuthal alignment as to their excursions, they do not work against each other and little or no force is exerted against any other part.

The bundle of conductor elements 21 is enveloped by an outer tube 23, which is also corrugated so that the entire assembly remains flexible. The outer tube holds the conductors 21 in place because they are not stranded. Reference numeral 24 refers to the gaps between the conductor elements because they are likewise not tightly juxtaposed.

The conductor assembly can be used also as the inner conductor in a gas-filled cable. Therefore, spacer elements of known construction must be provided on that conductor configuration, and an outer tube (such as 2 in FIG. 2) can be placed thereon to establish the gas-filled insulation space around the inner conductor.

FIGS. 6 and 7 illustrate a more complex inner conductor being comprised of several lays of such conductor elements. FIG. 6 shows only the inner lay on carrier tube 22 and the several conductors 21 are held in place here by a plastic ribbon 25, made e.g. on the basis of polyterepthalate. However, ribbon 25 could also be a metal strip. Such a strip is helically wrapped around the conductors 21, holding them in place on carrier tube 22. One could wrap such a ribbon on the lay and in a gapless pattern with overlapping loops. Alternatively, a strip could be longitudinally applied and folded lengthwise around the tube-plus-conductor element subassembly. The next layer of meandering conductor elements is then placed on top, etc.

FIG. 7 illustrates a multi-lay assembly in cross-section and the outer tube 26 is placed around the outermost lay of conductors. In principle, no additional wrapping is needed around the outermost conductor elements (or around the single lay of FIGS. 4 and 5). However, it may be practical to provide such a wrapping or envelope to better hold that lay in place. Also, such a wrapping, e.g. a conductive foil, may be very useful to facilitate gliding of the expanding conductors.

As stated, the conductor elements may be preformed into a meander pattern, which is advisable if they are relatively thick and solid. However, each conductor element may consist of stranded filaments in which case the wave contour is better established during placing the conductor elements onto the carrier tube or the lay underneath. Also, the excursion of the conductor elements may be different from lay to lay.

The invention is not limited to the embodiments described above but all changes and modifications thereof not constituting departures from the spirit and scope of the invention are intended to be included.

I claim:

1. A conductor assembly for use in an electrical cable for purposes of transmission of large quantities of electrical energy and being comprised of plural, segment shaped elements, arranged in one or several layers on a carrier element, the segments each having a small end in engagement with the carrier, further having a large end, the large ends delineating a periphery of the cable, each segment having two sides, the elements of a layer being placed with a gap between the sides of respective two adjacent ones of the elements and for the length of the conductor assembly to permit lateral displacement in a wave-like pattern upon being heated by a large electric current.

2. A conductor as in claim 1, wherein the sum of angular spacings between the elements is between about 1 and 10% of the periphery of the circle.

3. A conductor as in claim 1, wherein the sum of angular spacings between the elements is between about 2 and 5% of the periphery of the circle.

4. A conductor as in claim 2, there being plural lays of such conductor elements.

5. A conductor as in claim 1, at least the inner lay or lays being additionally wrapped in a ribbon or ribbons.

6. A conductor as in claim 1, said carrier element being a corrugated tube.

7. A conductor as in claim 1, and including an outer corrugated tube.

* * * * *